United States Patent [19]

Steljes

[11] Patent Number: 5,023,962

[45] Date of Patent: Jun. 18, 1991

[54] BEDSIDE COMMODE STATION FOR INVALID PATIENTS

[76] Inventor: Robert C. Steljes, P.O. Box 1479, Marion, N.C. 28752-1479

[21] Appl. No.: 609,478

[22] Filed: Nov. 5, 1990

[51] Int. Cl.[5] ..... A47K 11/06; A61G 7/08

[52] U.S. Cl. ..... 4/480; 4/479; 5/81 R

[58] Field of Search ..... 4/480, 476, 478, 479, 4/483, 254; 5/81 R, 503, 508, 83, 85; 439/255, 258

[56] References Cited

U.S. PATENT DOCUMENTS 3,854,773 12/1974 Thomas ..... 4/480
4,613,994 9/1986 Oates ..... 4/480
4,837,868 6/1989 Allen ..... 4/480
4,894,871 1/1990 Schmerler ..... 4/254

*Primary Examiner*—Henry J. Recla
*Assistant Examiner*—David J. Walczak
*Attorney, Agent, or Firm*—John Corbin

[57] ABSTRACT

A bedside commode station includes a bedside commode (10) and a handrail device (36), each of which is securely fastened to a common platform (54). The commode comprises a frame (25) which supports a waste container (26). The commode and the handrail are secured to the platform so as to enable an invalid patient to walk or maneuver safely to and from the patient's bed and the bedside commode without the aid of an attendant. The commode station is particularly useful in assisting an invalid patient who is no longer able to rise unaided to a standing position and who is incapable of safely maneuvering a portable walking device.

8 Claims, 3 Drawing Sheets

BEDSIDE COMMODE STATION FOR INVALID PATIENTS

BACKGROUND

1. Field of Invention

This invention relates to invalid aids, specifically to handrail devices and bedside commodes.

2. Description of Prior Art

In order to meet the needs of invalid patients, inventors have, over the years, responded with aids for sitting and standing, portable walkers, and portable commode chairs. However, there are invalid patients who have lost their ability to safely handle these portable devices. For reasons of self-esteem and savings in nurse or attendant labor, it would be desirable if they could get out of their beds and walk safely to and from their commode chairs. However, none of the existing aids has been able to enable them to accomplish this task.

For example, U.S. Pat. No. 3,739,793 to Wilson (1973) discloses an aid for sitting down and standing up. However, it provides no aid to a patient who requires help in rising from a prone position on a bed to a sitting position on the side of the bed. Also, it does not provide the rigid support for transfer to a portable commode chair that is needed by an invalid patient who requires the continual support of a fixed handrail device.

Another U.S. Pat. No. 3,591,874 to O'Kennedy (1971), reveals a device which was designed to help invalids who are capable of walking to rise from a sitting position to a standing position. Once an invalid patient steps off of this device, it becomes unstable and does not support a patient needing constant, rigid support while walking to and from a bed and a commode chair.

U.S. Pat. No. 3,553,746 to Seiger (1971) describes a support device designed to help semi-invalids to get out of their beds. This device is mounted on rolling devices and does not provide the stability needed by a patient requiring a firm support to walk to and from a bed and a bedside commode.

U.S. Pat. No. 3,085,258 to Wolferts (1963) shows a holding device for invalid walkers which recognizes an invalid patient's difficulty in using a portable walker as an aid in helping the patient rise from a sitting position on a bed to a standing position. However, it provides no aid to an invalid patient who no longer is capable of safely using a portable walker.

U.S. Pat. No. 2,757,388 to Chisholm (1956) discloses a device designed to aid a patient in standing from a sitting position, in being rotated, and in sitting down. This device does not provide the stability required to aid the patient in rising from a prone position to a sitting position on a bed. Also, the patient can not use this device without an attendant to operate it.

U.S. Pat. No. 2,445,619 to Josephs (1948) shows a device designed to aid a patient in self-physical therapy but provides no method for assisting an invalid patient in moving to and from a bed and a bedside commode.

U.S. Pat. No. 4,334,330 to Marshall (1982) describes a bedside commode device designed to aid "a patient partially immobilized, such as with arm, leg and/or body casts" in moving back and forth from a bed and the commode. An invalid patient whose legs no longer have the agility and strength to safely maneuver a portable walker will find it extremely difficult to sit up on a bed and, while keeping both legs parallel to the bed, swing them out and over the commode platform and to pull into position on the commode. Getting back to bed will be an even more difficult operation for such an invalid patient. The alternative embodiments of this invention will present still greater obstacles to this invalid patient.

U.S. Pat. No. 3,854,773 to Thomas (1974) describes a portable bedside commode device with provisions for raising and lowering its side arms. Lowering the side arm adjacent to the patient's bed makes it easier for the patient to slide from a bed onto the commode. However, for an invalid patient who requires a rigid device to pull on in order to move on and off of a bed and who must have such a device in order to get up off of the commode, this invention will not meet this patient's requirements.

OBJECTS AND ADVANTAGES

Accordingly, one object of this invention is to provide a bedside commode station which enables an invalid patient, who can not safely manuever portable walking aid devices, to safely manuever between the patient's bed and the patient's bedside commode. Another object is to provide a bedside commode station for an invalid patient and who can not rise to a standing position without aid. Additional objects and advantages of this invention are:

(a) to provide a rigid platform for the mounting of a handrail device and a bedside commode;

(b) to provide a bedside commode securely fastened to the platform and which, when positioned next to an invalid patient's bed, the adjacent arm of the bedside commode can be used as an aid by the patient to move from a prone position on the bed to a sitting position on the side of the bed;

(c) to provide a handrail device securely fastened to the above platform and so positioned on the platform that it can be easily reached by the patient while sitting on the side of a bed and which will enable the patient to pull to a standing position on the platform;

(d) to position the handrail device on the platform such that the standing invalid patient may safely transfer from the handrail device to the bedside commode without having to move the handrail device and without having to negotiate around it;

(e) to provide a bedside commode device which is securely fastened to the above platform and which will not move or tilt when the weight of the patient transfers from the handrail device to one of the arms of the bedside commode;

(f) to provide the handrail device in the proper position to aid the invalid patient in standing up from the bedside commode;

(g) to provide the handrail device to aid the invalid patient in standing while being cleaned and while being bathed;

(h) to provide the handrail device such that it will enable the invalid patient to return safely to bed;

(i) to provide a bedside station that is simple for an invalid patient to use;

(j) to provide the bedside commode station such that it can be moved from room to room through normal doors without having to be disassembled and reassembled; and (k) to provide a unit that is easy and economical to build and manufacture.

Further objects and advantages of my invention will become apparent from a consideration of the drawings and ensuing description.

DRAWING FIGURES

Figure 1:
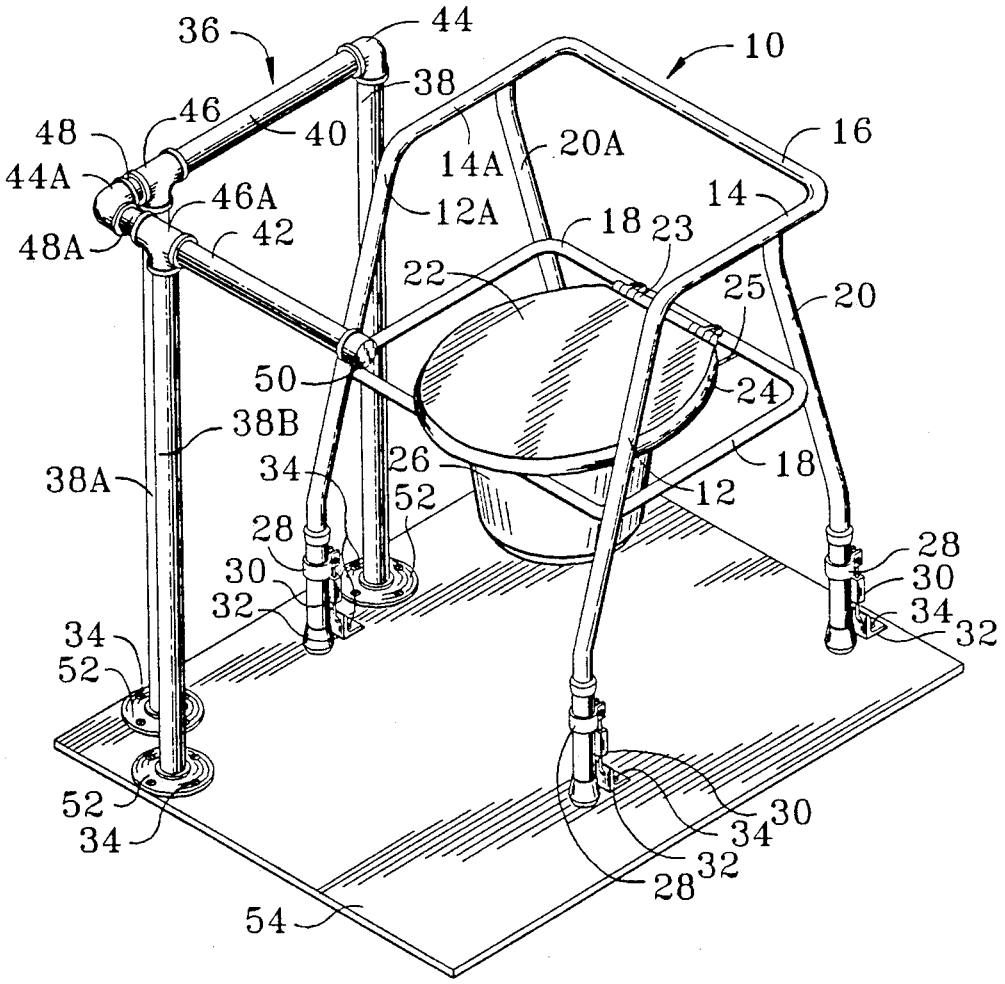
FIG. 1 is a perspective view of a bedside commode station in accordance with a preferred embodiment of the invention, preferably for use on the right side of a patient's bed.

| Reference Numerals In Drawings | |
|---|---|
| 10 bedside commode | 38 rear leg |
| 12 front leg | 38A middle leg |
| 12A front leg | 38B front leg |
| 14 side portion | 38C front leg |
| 14A side portion | 38D front leg |
| 16 back rest | 40 side arm |
| 18 leg brace | 42 front arm |
| 20 rear leg | 43 front arm |
| 20A rear leg | 44 elbow |
| 22 seat cover | 44A elbow |
| 23 hinge | 44B elbow |
| 24 seat | 44C elbow |
| 25 wire support frame | 46 tee |
| 26 receptacle | 46A tee |
| 28 toggle leg clamp | 48 nipple |
| 30 toggle | 48A nipple |
| 32 toggle mounting bracket | 50 end cap |
| 34 fastener | 52 mounting flange |
| 36 handrail device | 54 platform |
| 37 handrail device | |

DESCRIPTION——FIGS. 1 TO 3

Figure 2:
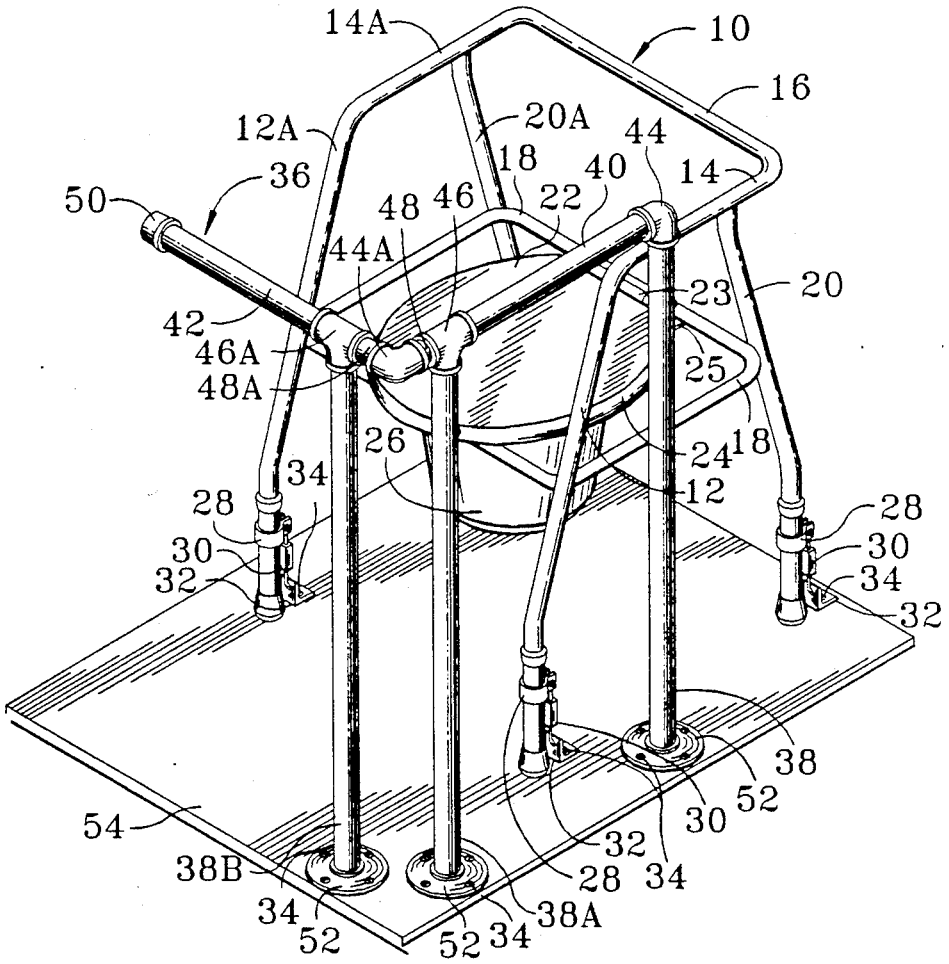
FIG. 2 is a perspective view of the commode station, preferred for use on the left side of the patient's bed.
Figure 3:
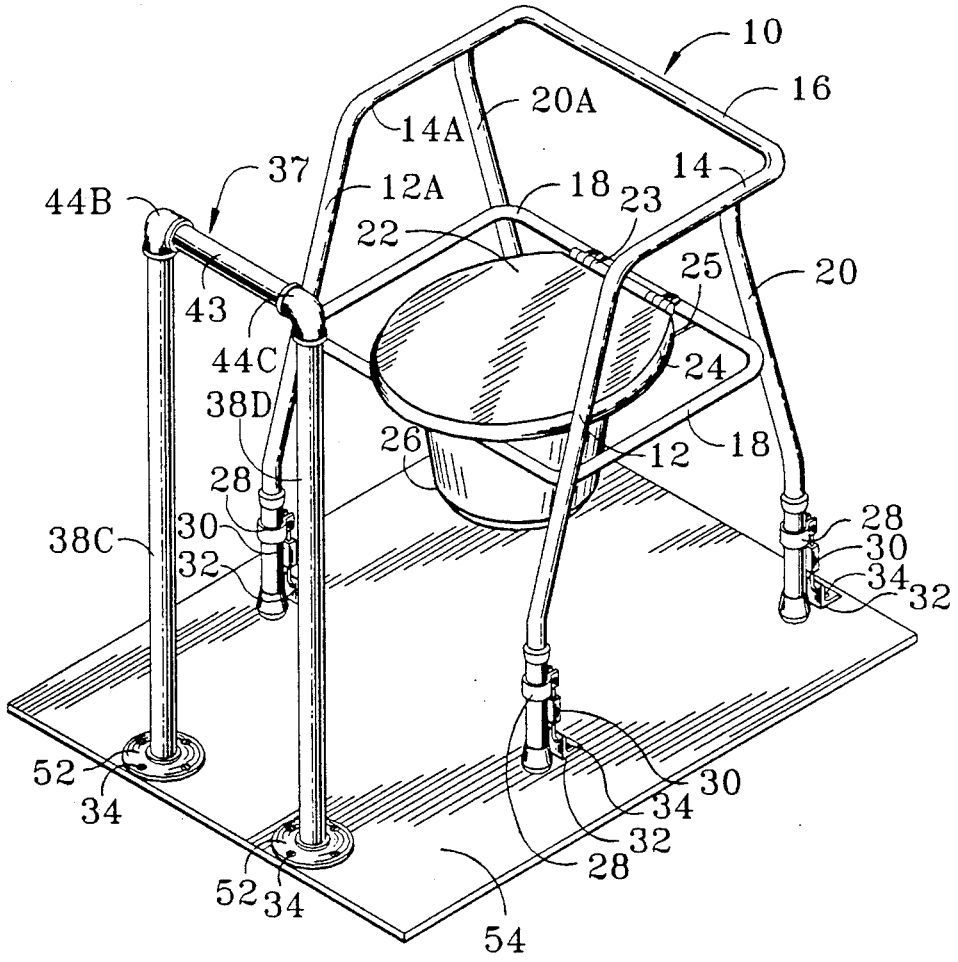
FIG. 3 is a perspective view of the commode station which can be used on either side or between two patient's beds.

In accordance with the invention, I provide a bedside commode station in which FIGS. 1 through 3 show a bedside commode 10. Commode 10 consists of a frame, a waste receptacle, a seat and a cover. The frame and a handrail device are securely attached to a support platform. The frame, formed preferably from 2.5 cm OD chromed plated steel tubing, has two front legs 12 and 12A, two rear legs 20 and 20A, two side portions 14 and 14A, and a back rest 16. All four legs are connected by a rectangular leg brace 18 about 42 cm×53 cm. A seat 24 and a seat cover 22 are mounted to a hinge 23. Hinge 23 pivotably attaches the rear end of cover 22 to one section of brace 18. A removable receptacle 26 for receiving body wastes has an upper rim by which it is -supported on a stainless steel, approximately 6 mm OD, wire support frame 25. Wire support frame 25 is mounted to the front and rear portions of leg brace 18, preferably by welding. The four legs are fastened rigidly to a platform 54 by four respective toggle leg clamps 28 which are connected by four respective toggles 30 to four toggle mounting brackets 32. Toggle mounting brackets 32 are securely fastened to platform 54 by four fasteners 34. Other methods of rigidly mounting the commode to the platform are feasible and will be obvious to those skilled in the art.

The preferred embodiment of the commode station is shown in FIGS. 1 and 2. These figures illustrate a handrail device 36. The components of handrail 36 are the same in both FIGS. 1 and 2 but are positioned so that the arrangement in FIG. 1 is more suitable for use on the right side of a patient's bed, while the arrangement of FIG. 2 is more practical for use on the left side. An elbow 44 connects rear leg 38 to side arm 40. A tee 46 connects side arm 40 to middle leg 38A and nipple 48. Elbow 44A connects nipple 48 to nipple 48A which, in turn, is connected to tee 46A. Tee 46A connects front leg 38B and front arm 42. End cap 50 is connected to front arm 42. The length of front arm 42 is such that a patient may easily reach it from a sitting position on the side of a bed. The height of front arm 42 is approximately 90 cm and is such that front arm 42 will aid the patient in pulling up from a sitting position on the side of the bed to a standing position on platform 54. Mounting flanges 52 are connected to each leg and are securely fastened to platform 54 by fasteners 34.

As shown in FIG. 1, mounting flanges 52 are positioned adjacent to the edges of the side and end of platform 54. Sufficient distance is provided between front arm 42 and front legs 12 and 12A to enable the patient to safely move to and from a bed and bedside commode 10.

FIG. 3 illustrates an alternative handrail device 37 which differs from device 36 of FIGS. 1 and 2 in that it consists of two front legs and a front arm joined together by two elbows. This embodiment of the commode station may be used on either side of a patient's bed. It may also be used between two beds which are positioned so as to facilitate its use by patients from both beds. Front leg 38C is connected to elbow 44B which is connected to front arm 43. Elbow 44C connects front arm 43 to front leg 38D. Mounting flanges 52 are connected to each leg and are securely fastened to platform 54 by fasteners 34. As shown in FIG. 3, mounting flanges 52 are positioned adjacent to the end of platform 54. The distance between leg 38C and its adjacent platform side equals the distance between leg 38D and its adjacent platform side. Additionally, mounting flanges 52 are positioned so that the distance between leg 38C or leg 38D and legs 12 and 12A will provide sufficient room to enable a patient to move safely to and from a bed and commode 10. Also, legs 38C and 38D are positioned so that a patient sitting on the side of a bed may easily reach the leg that is adjacent to the bed. The height of legs 38C and 38D is such that the leg adjacent to the patient's bed will aid the patient in pulling up from a sitting position on the side of the bed to a standing position on platform 54. The height of arm 43 is the same as arm 42 of FIGS. 1 and 2.

Handrail devices 36 and 37, illustrated in FIGS. 1, 2, and 3, are shown as steel pipe assemblies, preferably 3.3 cm OD. The pipe connections may be made by using pipe threads, welds, or other suitable methods of construction. Other materials, such as wood, plastic, steel tubing, and aluminum tubing, may be used in the construction of the handrails. As an example, bent or formed tubing may be used to eliminate the above pipe connections. Other methods of securely fastening handrail devices to a platform will be obvious to those skilled in the art.

In the construction of one prototype, platform 54 was made of plywood. The thickness of the plywood is 1.27 cm such that platform 54 is rigid enough so as not to become unstable as a patient, with one or both feet on the platform, pulls on the handrail device to stand up or to sit down. The width of platform 54 is about 74 cm and is such that the commode station may be moved from room to room without disassembly. The length of platform 54 is approximately 95 cm. Removable casters may be attached if needed to facilitate moving this unit.

Other materials and other methods of constructing a platform to which a bedside commode and a handrail device may be securely fastened will be obvious to those skilled in the art.

OPERATION——FIGS. 1 TO 3

With reference to FIG. 1, the commode station is placed on the right side of the patient's bed (not shown) with front arm 42 pointing toward the bed and with front leg 12 and rear leg 20 directly against the bed. In this position, platform 54 will extend under the bed. The station is further positioned so that when the patient rises from a prone position on the bed to a sitting position on the side of the bed, the patient's feet will be placed on platform 54 in front of front leg 12.

Starting with the patient in a prone position in the bed, the patient may grasp front leg 12 or side portion 14 and use either or both, if needed, as an aide in pulling up to a sitting position on the side of the bed. With one or both feet placed on platform 54, the patient takes hold of front arm 42 with one or both hands and pulls up to a standing position on platform 54. With the patient's left hand holding onto front arm 42, the patient raises seat cover 22 with the right hand and then grasps either side arm 40 or side portion 14A with the right hand to aid in turning around and in sitting down on seat 24. As bedside commode 10 is securely fastened to platform 54 on which the patient is standing, the patient may also grasp side portion 14 with the left hand to aid in sitting down on seat 24, with cover 22 raised, without fear of the chair's moving or tilting. The patient eliminates body wastes (urine and feces) while seated comfortably on seat 24.

When the patient is ready to return to bed, the patient grasps front arm 42 with both hands and pulls up to a standing position. Alternatively, the patient may grip front arm 42 with the left hand and side arm 40 with the right hand and pull up to a standing position. The patient then turns toward the bed; and while holding onto front arm 42 with the right hand, the patient steps toward the bed, releases front arm 42 and grasps side portion 14 or leg 12 as a steadying aid while sitting down on the bed. The patient then returns to the original prone position.

Whenever it is convenient to do so, the person who is caring for the invalid patient cleans receptacle 26. This person raises seat cover 22 and seat 24 and easily lifts receptacle 26 out of wire support frame 25. Receptacle 26 is taken to a bathroom to be emptied and cleaned. After cleaning, it is returned to bedside commode 10 and placed in frame 25. Seat 24 and seat cover 22 are then closed.

The configuration shown in FIG. 2 has the same parts as shown in FIG. 1, but handrail device 36 is rearranged so as to facilitate the use of the commode station on the left side of the patient's bed. The positioning of and the operation of this configuration is identical to that described above for the embodiment shown in FIG. 1, except that opposite hands, legs, and side portions are used.

FIG. 3 illustrates a modification of the device of FIGS. 1 and 2 that may be used on either side of a patient's bed. It is positioned by the patient's bed so that either front leg 12 or 12A and rear leg 20 or 20A will be against the bed and so that platform 54 will extend under the bed. It is also positioned so that when the patient rises to a sitting position on the side of the bed, one or both feet will be placed on platform 54 in front of front leg 12 or 12A.

Assuming that this embodiment is positioned on the right side of the patient's bed, front leg 12 and side portion 14 may be used by the patient as an aid in moving from a prone position to a sitting position on the side of the bed. With one or both feet placed on platform 54, the patient takes hold of front leg 38D with either or both hands and pulls up to a standing position on platform 54. With the left hand holding on to front arm 43, the patient raises seat cover 22 with the right hand. To aid the patient in sitting down, the patient grips side portion 14A with the right hand. While firmly holding to side portion 14A, the patient releases front arm 43, turns around, and sits down on seat 24. The use of commode 10 and the cleaning of receptacle 26 are identical to that described above for the embodiment shown in FIG. 1.

When the patient is ready to return to bed, the patient grasps front arm 43 with both hands and pulls up to a standing position. The patient then turns toward the bed; and while holding onto front arm 43 with the right hand, the patient steps toward the bed, releases front arm 43 and grasps side portion 14 or leg 12 as a steadying aid while sitting down on the bed. The patient then returns to the original prone position.

The procedure described above applies when this embodiment is placed on the left side of the patient's bed, except that opposite hands, legs, and side portions are used. When this embodiment is positioned between two beds, the procedure for the given side of bed applies.

With reference to FIGS. 1, 2, and 3, a patient who no longer is capable of self-care in cleaning or bathing may use front arm 42 or 43 as a support while standing to be cleaned or to be bathed by an attendant.

SUMMARY, RAMIFICATIONS, AND SCOPE

The reader will see that the commode station of the invention will enable invalid patients, who can no longer safely maneuver portable walkers and who must have attendants to aid them in walking, to move safely between their beds and their bedside commodes without assistance from other persons. Besides increasing these patients' independence and emotional well-being, an obvious benefit of my commode station is the elimination of the need of their having to use a bedpan. Even after these patients decline in health and become too weak to pull themselves up and must have attendants to help them rise to a standing position, my commode station can be used instead of awkward, uncomfortable, demoralizing bedpans. Further, my commode station can be used to aid attendants in giving the patients their daily baths by providing a device to support them in a standing position while being bathed.

The preceding description provides illustrations of several of the presently preferred embodiments of this invention and should not be interpreted as limiting its scope. For example, the handrail device shown in FIG. 3 can be replaced with a T-shaped handrail device; leg 38 of FIGS. 1 and 2 can be eliminated and elbow 44 can be replaced with a duplicate of cap 50; the shape of the individual components of the handrail devices can be rectangular; a rigid platform can be made by mounting a material on a frame or made by the plastic molding process; commode devices other than the type illustrated can be rigidly mounted on a platform; other methods of securely mounting bedside commodes can be used, etc.

Accordingly, the scope of this invention should be determined by the attached claims and their legal equivalents and not limited by the examples given.

I claim:

1. A bedside commode station for location adjacent a patient's bed comprising in combination, a rigid continuous sheet of material forming a horizontal platform defining a peripheral edge, a bedside commode including a removable container and first frame means fastened to said platform for supporting said container above said platform, said first frame means being spaced from said peripheral edge, a handrail and second frame means for supporting said handrail to said platform, said handrail being spaced horizontally from said commode on said platform, said platform being of sufficient size to support said handrail at a sufficient distance from said commode to allow a patient to freely move between said handrail and said commode, said platform being of sufficient size to allow said peripheral edge adjacent said patient's bed to partially extend under said bed when said first frame is against said bed, and the platform being of sufficient rigidity to enable said patient to grip the handrail and pull up to a standing position on said platform without the platform becoming unstable.

2. The bedside station of claim 1 wherein said handrail includes a front arm and a side arm, said front arm and said side arm being connected to and supported by at least one leg fastened to said platform.

3. The bedside station of claim 2 wherein said arms have a predetermined height and position such as to aid said patient in pulling up to a standing position on said platform from said patient's bed or from said bedside commode.

4. The bedside station of claim 1 wherein said handrail includes a front arm, said front arm being connected to and supported by at least one leg fastened by fastening means to said platform.

5. The bedside station of claim 4 wherein said arm has a predetermined height and position such as to aid said patient in pulling up to a standing position on said platform from said patient's bed or from said bedside commode.

6. The bedside station of claim 1 wherein the width of said platform is less than 76 cm so that said bedside station can be moved through 76 cm doors without having to be disassembled and reassembled.

7. The bedside station of claim 1 wherein said handrail arrangement includes a front arm and a side arm, said front arm and said side arm being connected to and supported by one or more legs fastened by fastening means to said platform.

8. The bedside station of claim 1 wherein said first frame comprises a tubular frame having a horizontally oriented portion for receiving said container and a surrounding structure spaced from said portion for enabling a person to obtain support when using said container, and a cover hingedly attached to said frame for covering said container.

* * * * *

UNITED STATES PATENT AND TRADEMARK OFFICE

CERTIFICATE OF CORRECTION

PATENT NO. : 5,023,962

DATED : June 18, 1991

INVENTOR(S) : Robert C. Steljes

It is certified that error appears in the above-identified patent and that said Letters Patent is hereby corrected as shown below:

Column 3, under "Reference Numerals in Drawings," change:
"28 toggle leg clamp" to "28 turnbuckle leg clamp"
"30 toggle" to "30 turnbuckle"
"32 toggle mounting bracket" to "32 turnbuckle mounting bracket"

Column 3, line 55, change "toggle" to "turnbuckle."

Column 3, lines 56 and 57, change "toggles 30" to "turnbuckles 30."

Column 3, lines 57 and 58, change "toggle mounting brackets 32" to "turnbuckle mounting brackets 32."

Signed and Sealed this

Eighth Day of December, 1992

*Attest:*

*Attesting Officer*

DOUGLAS B. COMER

*Acting Commissioner of Patents and Trademarks.*